United States Patent [19]

Boski et al.

[11] 4,199,131

[45] Apr. 22, 1980

[54] ACTUATOR MODULE FOR WIRELINE CUTTING SAFETY VALVE

[75] Inventors: Israel Boski, Plano; Karl N. Tunstall, Dallas; M. L. Warren, Carrollton, all of Tex.

[73] Assignee: Otis Engineering Corporation, Dallas, Tex.

[21] Appl. No.: 836,154

[22] Filed: Sep. 23, 1977

[51] Int. Cl.[2] ..... F16K 31/122; F16K 31/00; F16L 37/18

[52] U.S. Cl. ..... 251/62; 251/291; 285/316; 285/319

[58] Field of Search ..... 251/62, 63, 291, 63.5, 251/327; 403/322, 289, 290, 361; 166/319, 321, 53; 92/130 C; 137/315; 285/316, 318, 319

[56] References Cited

U.S. PATENT DOCUMENTS

| | | | |
|---|---|---|---|
| 2,784,987 | 3/1957 | Cocoran | 285/316 |
| 3,290,003 | 12/1966 | Kessler | 251/291 |
| 3,330,341 | 7/1967 | Jackson et al. | 285/319 |
| 3,378,224 | 4/1968 | Boyle | 251/327 |
| 3,387,865 | 6/1968 | Ross | 285/319 |
| 3,635,793 | 1/1972 | Kolb et al. | 285/316 |
| 3,847,413 | 11/1974 | Gurley et al. | 285/316 |
| 3,958,592 | 5/1976 | Wells et al. | 251/291 |

*Primary Examiner*—Martin P. Schwadron
*Assistant Examiner*—A. Michael Chambers
*Attorney, Agent, or Firm*—H. Mathews Garland

[57] ABSTRACT

A portable add-on actuator module for use with a wireline cutting surface safety valve to provide supplemental energy for closing and simultaneously cutting a wireline extending through the surface safety valve in the event of an emergency. The unit includes a spring loaded locking collet assembly arranged to engage a locking recess within the stem of a surface safety valve so that the spring force may be added to normal valve closing forces such as line pressure and valve stem springs to supplement such forces for insuring the cutting by the surface valve member of a wireline extending through the member. The actuator module has a body which rests on the safety valve body without the use of any connecting structure. The module also includes structure for hydraulically compressing the spring for connecting the module on a safety valve and for hydraulically shifting the latching collet assembly to a disengaging condition for releasing the module from a safety valve.

3 Claims, 5 Drawing Figures

ACTUATOR MODULE FOR WIRELINE CUTTING SAFETY VALVE

SUMMARY OF THE INVENTION

This invention relates to surface safety valves for control of the flow of oil and gas from wells and the like and more particularly relates to an auxiliary unit for supplementing available energy in closing a wireline cutting surface safety valve.

In the oil and gas industry particularly in relation to the operation of oil and gas wells it is common practice to use surface safety valves which respond to certain monitored conditions to shut off the flow of oil or gas in the event of an emergency. Such safety valves and the systems in which they function are described and illustrated at pages 4014–4028 of the 1975–75 *Composite Catalog of Oilfield Equipment and Services,* published by World Oil, Houston, Tex. The safety valves are positioned in a wellhead tree and may monitor and close in response to predetermined high and low pressures in the flow line, fire, electrical failure, and other operating conditions which make shutting off flow along the wellhead a preferred safety procedure. The safety valves are available in a variety of types using various closing forces. In some such valves the valve member is held open by an independent hydraulic pressure and is closed by the pressure in the line being controlled when the independent hydraulic pressure is reduced. In other designs the closing of the safety valve is assisted by the force of a spring. During the production life of wells using safety valves it may be necessary to perform various well service operations which are carried out using wireline equipment and procedures of the general nature described and illustrated at pages 3977–3992 of the 1974–75 edition of the *Composite Catalog of Oilfield Equipment and Services,* supra. During the servicing of a well using wireline equipment, the wireline on which the equipment is run into the well and pulled from the well is disposed through the surface safety valve during the time that the equipment is actually in the well. It will be apparent that under such circumstances the surface safety valve may be closed only by removal of the wireline or alternatively, by the valve member of the safety valve cutting the wireline to permit the valve to shift to the closed position. It will be recognized when a safety valve closes cutting a wireline a scissor action occurs between the valve member and the valve body along the edge of the valve port through the valve member sliding past the edge of the opening into the valve body flow passage adjacent to the valve member. In systems where the flow line pressure is substantial no problem is generally presented as the pressure in the flow line is sufficient to shift the valve closed even against the resistance of a wireline extending through the valve. Problems are, however, presented in flow systems operating under low pressure such as below 100 pounds per square inch and under circumstances where there is no pressure in the flow line. Thus, little or no force exists to close the safety valve when the pressure in the valve body is low or nonexistent. Also the spring force available in such valves frequently is not sufficiently great to close the valve cutting a wireline through the valve. It is therefore desirable, with certain safety valves operating under flow conditions which are inadequate to close the valves with a wireline passing through the valve, to have available an auxiliary source of force which is adequate to overcome the resistance of a wireline.

OBJECTS OF THE INVENTION

It is a principal object of the invention to provide an actuator module for wireline cutting safety valves used in a wellhead of oil and gas systems.

It is another object of the invention to provide a portable add-on device of the character described which may be used with existing safety valves.

It is another object of the invention to provide a device of the character described which is connected to a safety valve by use of only a collet assembly which releasably couples with the valve stem of the safety valve with the module body resting on supporting surfaces of the safety valve body.

It is another object of the invention to provide a device of the character described which uses the force of compressed springs to supplement the safety valve closing force or forces.

It is another object of the invention to provide a device of the character described which may be coupled with the safety valve in both the open and closed conditions of the safety valve.

It is another object of the invention to provide a device of the character described which may be released from a safety valve when the safety valve is either opened or closed.

It is another object of the invention to provide a device of the character described in which the springs used to provide auxiliary force may be compressed by application of hydraulic pressure and similarly the latching collet assembly may be shifted to a release condition by use of hydraulic pressure.

In accordance with the invention there is provided a portable add-on type actuator module for wireline cutting safety valves which includes a housing having shoulder surfaces engageable with shoulder surfaces on the body of a surface safety valve, an annular piston movable in the body, a spring engaged with the piston and adapted to be compressed by hydraulic force on one side of the piston and to extend in a direction away from the valve body for applying supplementary force to the valve stem, and a latching collet assembly coupled with the piston for releasably engaging a safety valve stem for applying the force of the compressed springs to the safety valve stem and including means for releasing the collet assembly from the safety valve stem in response to hydraulic pressure applied to the collet assembly. The actuator module may be connected with and disengaged from a safety valve which is either open or closed.

A preferred embodiment of an actuator module for a wireline cutting safety valve in accordance with the invention together with its objects and advantages will be better understood from the following detail description thereof taken in conjunction with the accompanying drawings wherein:

DETAILED DESCRIPTION OF THE DRAWINGS

Figure 1:
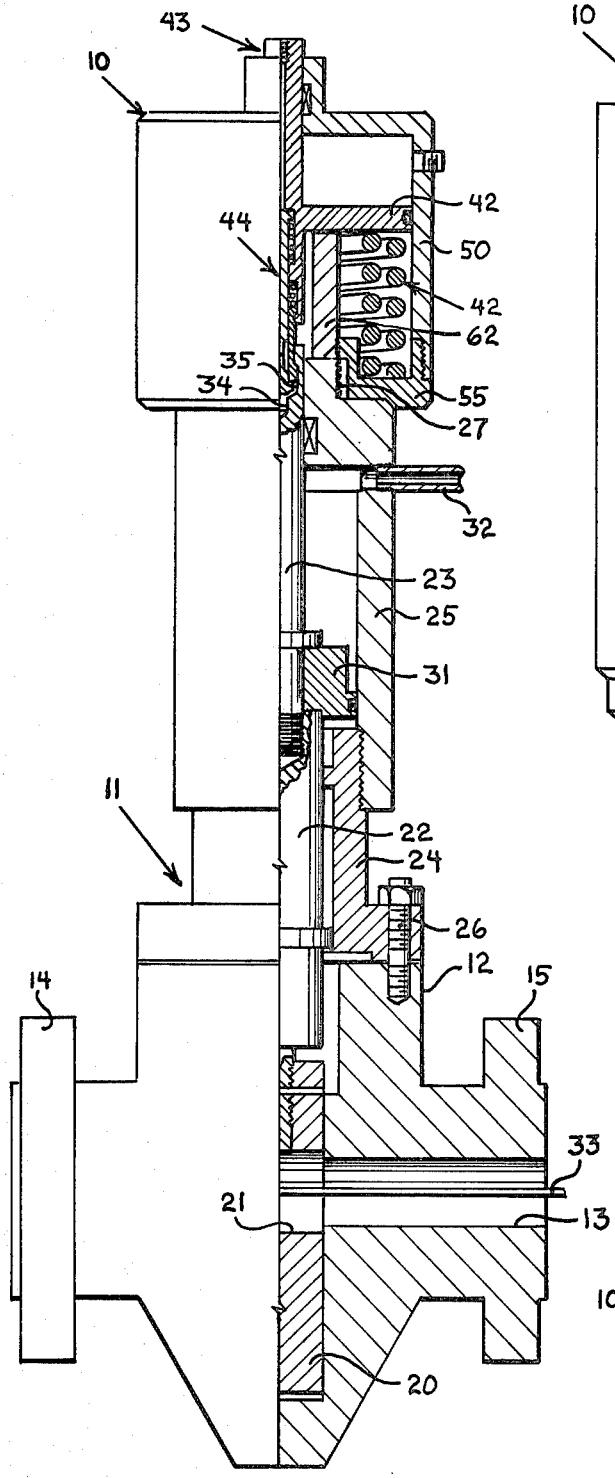
FIG. 1 is a generally schematic view in section and elevation of an actuator module in accordance with the invention mounted on one form of wireline cutting surface safety valve with which the module is usable.

Referring to FIG. 1 of the drawings, an actuator module 10 embodying the features of the invention is shown installed in "cocked" condition on a wireline cutting surface safety valve 11. The valve 11 is an available unit the type generally illustrated and described at page 1426 of the *Composite Catalog of Oilfield Equipment and Services,* supra. The valve 11 includes a body 12 provided with a bore 13 defining a flow passage through the valve and with opposite end flanges 14 and 15 for connecting the valve in a flow line through which oil or gas flow is controlled by the valve. A valve member 20 having a port 21 for controlling flow through the valve bore 13 is mounted for sliding movement between an open position as illustrated in FIG. 1 at which the port 21 is aligned with the bore 13 and a closed position, not shown, at which the valve member is moved to misalign the port 21 with the valve body bore. The valve member 20 is connected with a lower stem 22 which is secured with an upper stem 23. The lower and upper stems are housed in a bonnet 24 and a cylinder 25 secured on the valve body secured by bolt 26. The cylinder has a threaded reduced upper end covered by a thread protector sleeve 27. The upper end of the cylinder defines a seat 28 for the actuator module 10. A piston 31 on the upper stem 23 in the cylinder holds the valve stems down at a valve-open position in response to hydraulic pressure in the cylinder from a line 32 connected into the cylinder from a source, not shown, of hydraulic fluid pressure which preferably is a hydraulic control manifold of the general type described and illustrated at page 4022 of the *Composite Catalog of Oilfield Equipment and Services,* supra. The hydraulic fluid pressure from the line 32 in the cylinder 25 acts on the piston 31 holding the stems 22 and 23 at a lower end position at which the valve member 20 is open, FIG. 1. The hydraulic control manifold may respond to any of a number of operating conditions which relieve the hydraulic pressure to allow the flow line pressure in the bore 13 of the valve 11 to move the valve member 20 upwardly to the closed position. For explaining the present invention, a wireline 33 is shown passing through the valve port 21 and the bore 13 of the valve 11. As previously discussed, the wireline 33 extends from surface operating equipment, not shown, to downhole well servicing equipment, not shown, in carrying out various well servicing operations. It will be apparent that the valve member 20 may not close with the wire line 33 extending through the valve except by cutting the wireline. The edges of the valve member bore at the opposite ends of the bore 21 and the valve body edges around the bore 13 at the valve member 20 are sufficiently hardened to cut the wireline when adequate force is applied to the valve member 20. The function of the actuator module 10 is to supply sufficient additional force to the valve stem 23 in excess of that provided by the line pressure within the bore of the valve 11 to cut the wireline 33 as the valve is closed. For purposes of adapting the valve 11 to accept the actuator module the upper end of the valve stem 23 is provided with an upwardly opening blind bore 34 having an internal annular locking recess 35 to receive the operating collet assembly of the actuator module for coupling the collet assembly with the safety valve stem as described below.

Figure 3:
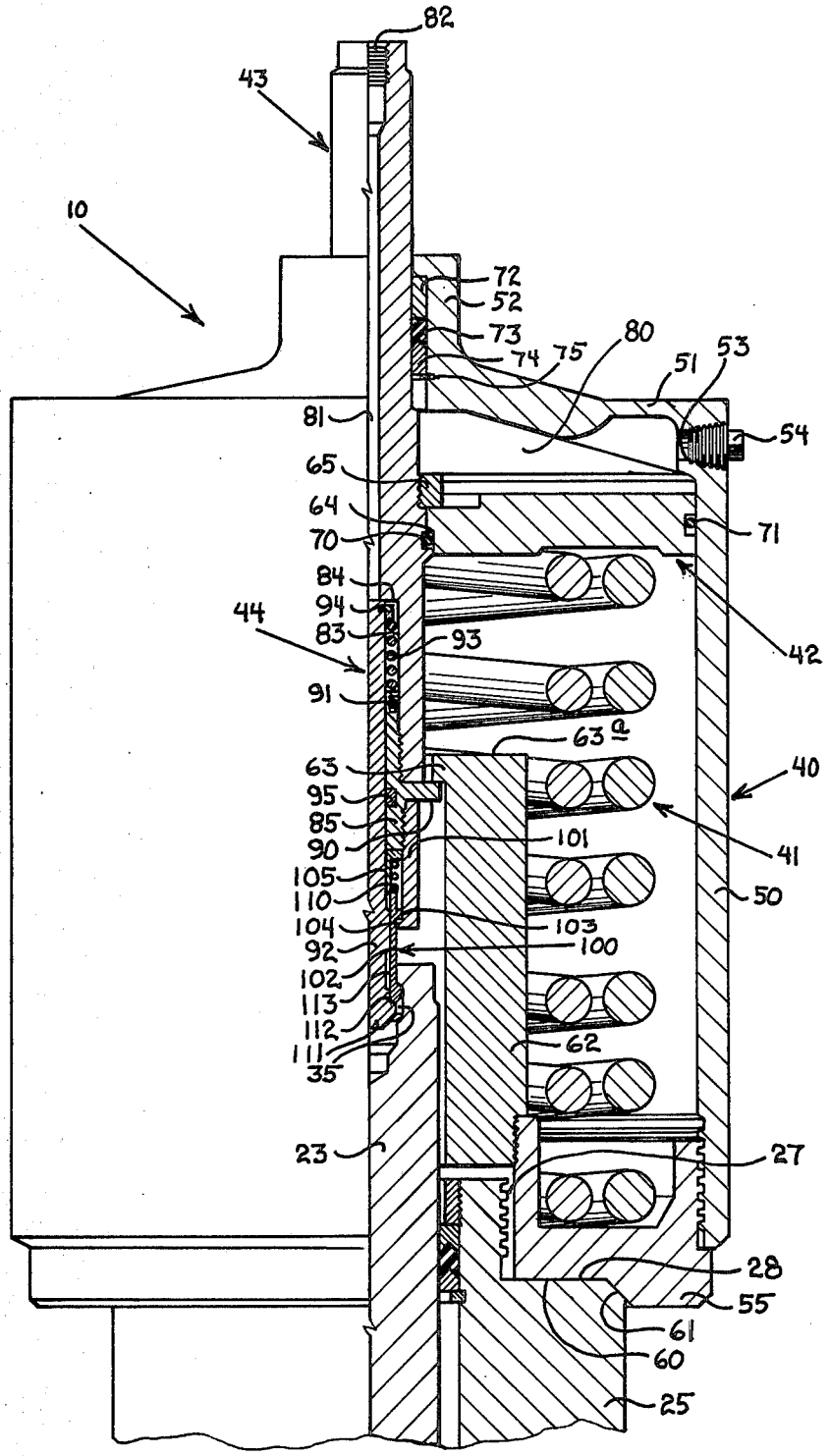
FIG. 3 is a much enlarged fragmentary view in section and elevation showing the specific structural details of the actuator module of the invention illustrating the springs of the module fully expanded and the safety valve stem moved upwardly as when the safety valve is fully closed after cutting a wireline through the valve.
Figure 5:
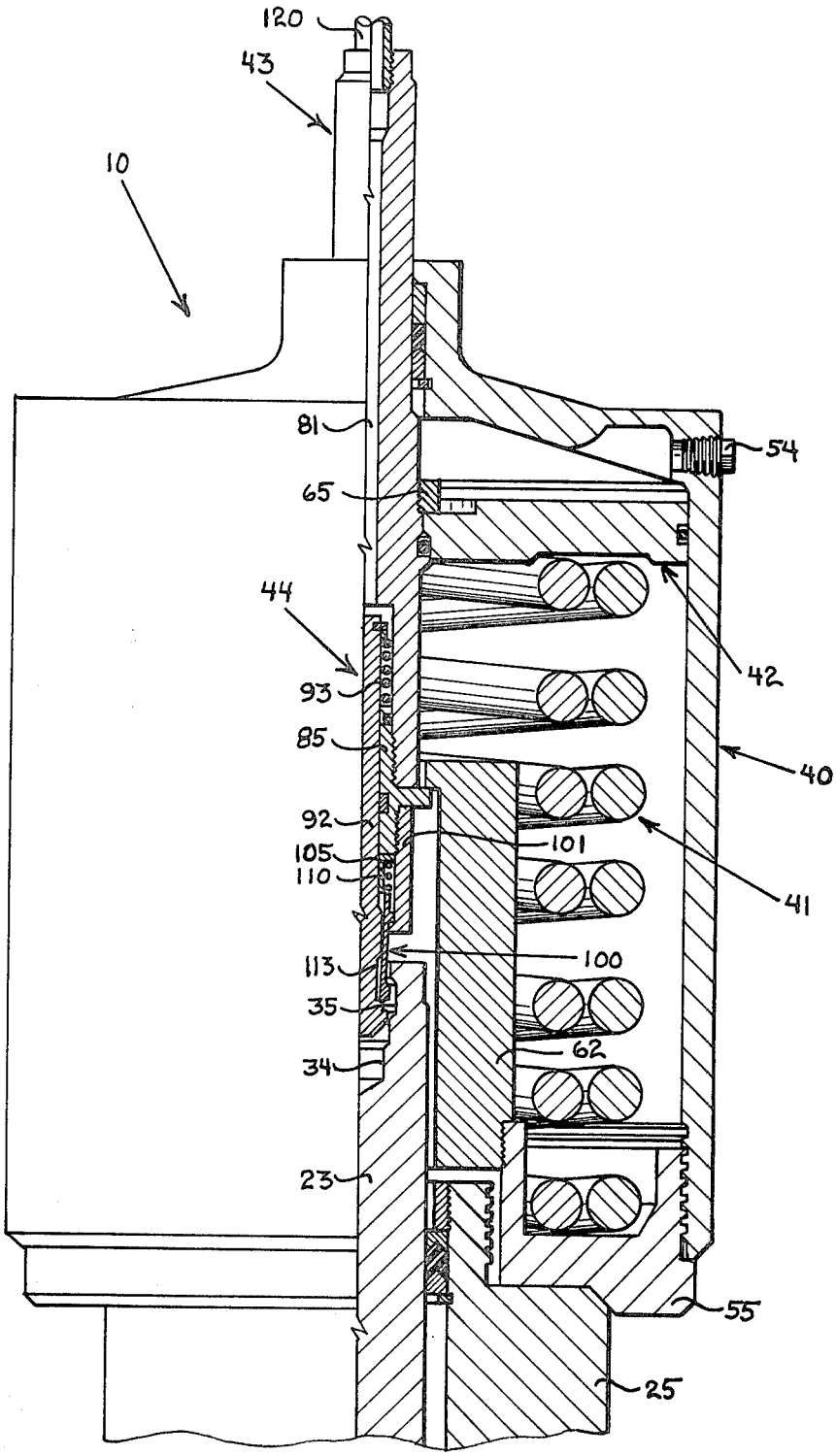
FIG. 5 is a longitudinal fragmentary view in section and elevation of the actuator module showing the step of shifting the latching collet assembly to a release condition for removal of the module from a safety valve which is closed with the valve stem extended upwardly.

Referring to FIGS. 3 and 5 which show the structural details of a preferred embodiment of the actuator module of the invention, the module 10 includes a cylindrical housing 40, a spring assembly 41, a piston 42, a piston rod 43, and a collet assembly 44. The spring assembly applies an upward force to the piston which is transmitted through the piston rod and the collet assembly to the valve stem 23 of the safety valve 11 for applying the supplementary foce of the compressed spring assembly to the safety valve to assist in closing the valve insuring the necessary force for the safety valve to cut a wireline 33 extending through the valve. The spring assembly may be compressed by hydraulic pressure when the module is coupled with the safety valve. The collet assembly is operable by hydraulic pressure for release of the module from the safety valve.

As shown in FIGS. 3 and 5 the cylindrical housing 40 of the actuator module 10 includes an outer wall member 50 formed integral with a top 51 which has a packing retainer flange portion 52. The side wall 50 is provided with a side port 53 which is internally threaded to accept a pipe plug 54 for sealing the cylinder chamber above the piston as shown in FIGS. 3 and 5, or a needle valve, not shown, to permit flow of hydraulic fluid into and out of the cylinder chamber. An annular base member 55 is threaded into the lower end of the cylinder wall portion 50. The base member 55 has bottom support surfaces 60 and 61 which are sized and shaped to conform to the upper end size and shape of the hydraulic cylinder portion 25 of the surface safety valve 11. When the module 10 is in operating relationship on the safety valve 11, the module is supported on the safety valve cylinder housing by the surfaces 60 and 61 without the use of threaded connections or any other securing means between the module and safety valve housings which limits the connection procedure to the only coupling of the collet assembly 44 into the safety valve stem as described below. A tubular inner wall member 62 is threaded along a lower end portion into the annular base member 55. The inner wall member has an internal annular stop flange 63 which limits the upward movement of the piston 42 and the piston rod 43 and an upper end piston stop 63*a*.

As shown in FIG. 3, the piston 42 of the actuator module 10 is secured on an external flange portion 64 of the piston rod 43 by a retainer ring 65. An o-ring seal 70 within an external annular recess of the piston rod flange seals between the rod and the piston 42. An external annular o-ring seal 71 is disposed in an external annular recess around the piston 42 providing a sliding seal between the piston and the inner wall surface of the cylinder member 50. The packing retainer flange 52 at the top of the module housing holds a seal assembly sealing with the piston rod 43 which includes a packing retainer ring 72, a backup ring 73, a U-cup seal 74, and a retainer ring 75. Thus, an upper sealed chamber 80 is defined within the actuator module cylinder above the piston 42 for hydraulic fluid introduced through the side port 53 to charge the chamber for compressing the spring assembly 41 as required.

Figure 2:
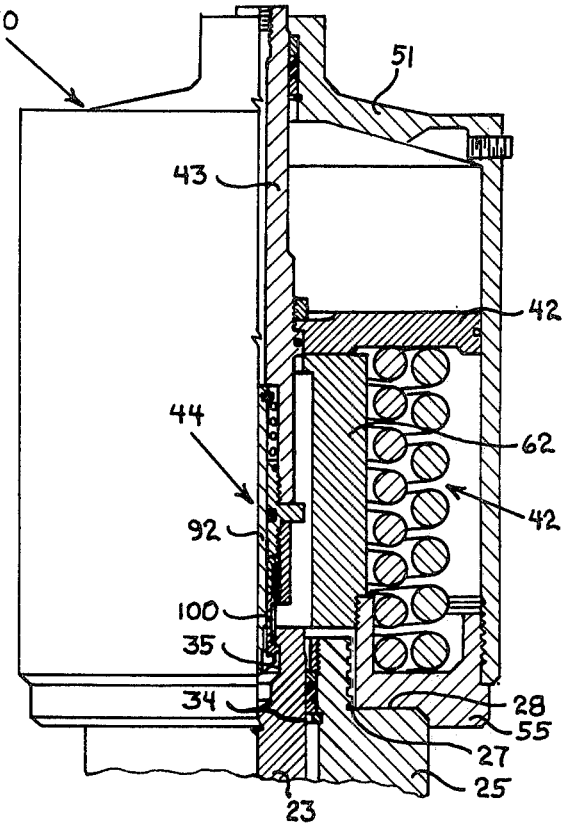
FIG. 2 is a fragmentary view in section and elevation showing the module as shown in FIG. 1 coupled with the safety valve in the "cocked" condition as when the safety valve is open.

Referring particularly to FIGS. 3 and 5 the collet assembly 44 is carried by the piston rod 43 for releasably coupling the piston rod with the stem 23 of the surface safety valve 11. The piston rod 43 is provided with a longitudinal bore 81 which has an enlarged internally threaded upper end portion 82 and an enlarged downwardly opening lower end portion 83 the upper end of which defines an internal stop shoulder surface 84. A tubular shaped adaptor 85 is threaded into the lower end of the piston rod. The adaptor 85 has a central external annular flange portion 90 which engages the lower end edge of the piston rod limiting the extent to which the adaptor may thread into the piston rod and extending outwardly sufficiently to define an external annular stop flange on the piston rod which is engageable with the bottom surface of the stop flange 63 in the member 62 limiting the upward movement of the piston rod and piston. A ring seal 91 carried by the adaptor 85 above the flange 90 seals between the adaptor and the bore portion 83 of the piston rod. A collet operator rod 92 fits in sliding relationship through the adaptor 85 into the bore portion 83 of the piston rod. A spring 93 is disposed around the upper end portion of the collet operator rod within the piston rod bore portion 83 confined between the upper end of the adaptor 85 and a retainer ring 94 secured around the upper end of the operator rod 92. The spring 93 biases the collet operator rod to an upper end "collet locking" position as illustrated in FIGS. 1, 2 and 3. A seal 95 within the adaptor 85 seals around the operator rod 92 with the bore of the adaptor so that a hydraulic fluid pressure applied in the bore 81 above the operator rod will apply a downward force on the operator rod to urge the rod downwardly relative to the piston rod. A locking collet 100 is supported around the collet operator rod 92 by a retainer sleeve 101 which is threaded on the lower end portion of the adaptor 85. The collet 100 is provided with a plurality of circumferentially spaced dependent collet fingers 102 which may radially expand and contract sufficiently to lock and release in the recess 35 within the upper end of the safety valve upper stem 23. The collet 100 has an external annular flange 103 which fits above and engages an internal annular flange along the lower end of the retainer sleeve 101 for holding the upper end portion of the collet within the retainer sleeve. A tubular spring guide and retainer 105 is fitted within the sleeve 101 around the operator rod 92 engaging the lower end edge of the adaptor 85. A spring 110 is disposed within the sleeve 101 around the operator rod 92 and spring guide 105 confined between the flange 103 on the collet 100 and an external annular flange on the upper end of the spring guide 105 for biasing the collet 100 downwardly. The spring 110 urges the collet toward a locking position along the operator rod 92 while allowing the collet to be moved upwardly to a release position along the operator rod. The operator rod 92 has a graduated lower end portion including an enlarged locking foot 111, a reduced locking surface 112, and a further reduced release surface 113 above the locking surface. Between the locking foot 111 and the reduced locking surface 112 an upwardly facing external annular stop shoulder is defined on the locking foot which limits the relative downward movement of the collet fingers on the operator rod to hold the collet at a longitudinal position on the rod at which the locking fingers are disposed around the locking surface. The release surface 113 is sized to allow the collet fingers when aligned with the release surface to be compressed inwardly sufficiently that the collet fingers may pass into and out of the locking recess 35 in the upper end of the upper stem 23 of the safety valve 11. At all times during the operation of the collet assembly the operator rod 92 remains fully disposed through the collet 100 with the lock and release functions of the collet depending upon whether the collet fingers are aligned along the locking surface 112 of the rod or along the release surface 113 of the rod.

The relative positions of the various parts of the actuator module 10 in the unactivated or "uncocked" condition of the module before installation on a surface safety valve 11 and when installed on a safety valve with the safety valve at the closed position are both illustrated in FIG. 3. Referring to FIG. 3, under such circumstances the spring assembly 41 is fully extended with the piston 42 at an upper position at which the flange 90 engages the internal flange 63 within the member 62. Similarly the spring 93 is fully extended holding the operator rod 92 at an upper end position while the spring 110 is also fully extended holding the locking collet 100 at a lower end position on the rod 92 so that the heads of the collet fingers 102 rest against the flange on the rod foot 111 along the collet lock surface 112 on the rod. The actuator module may be installed on the safety valve when the safety valve is open as shown in FIG. 1 or when the safety valve is closed with the safety valve stems at an upper position as represented in FIG. 3. When the actuator module is in the relaxed condition of FIG. 3 it can be installed only on a closed safety valve which is the only condition of the safety valve in which the upper stem 23 of the valve extends upwardly a sufficient height to engage the locking collet assembly 44 of the module at the retracted position of the collet assembly when the module is relaxed or "uncocked". In order to install the module on an open safety valve as represented in FIG. 1 it is necessary that the collet assembly 44 be extended downwardly to a lower end position as represented in FIG. 2 which is attained when the spring assembly 41 is fully compressed at the time that the piston 42 engages the upper end surface of the member 62.

Figure 4:
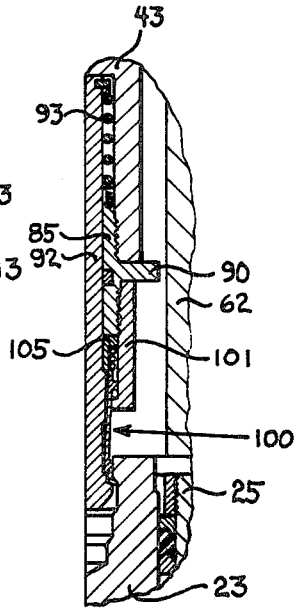
FIG. 4 is a fragmentary view in section showing the relative positions of the various parts of the actuator module when the module is being installed on a safety valve which is open with the valve stem retracted downwardly.

The installation of the actuator module 10 on a closed surface safety valve 11 as represented in FIG. 3 is carried out as follows. The module in the relaxed condition represented in FIG. 3 is positioned over the safety valve and lowered downwardly guiding the base member 55 of the module toward the upper end of the safety valve operating cylinder 25. It will be recognized that since the safety valve 11 is closed an upper end portion of the upper stem 23 of the safety valve extends above the upper end edge of the head of the cylinder 25 as seen in FIG. 3. As the actuator module is lowered toward the safety valve cylinder the collet 100 and the collet operator rod 92 are guided toward the blind bore 34 in the upper end of the upper stem 23 of the safety valve. As the collet and collet operator rod move toward the valve stem bore the collet is in the position on the operator rod illustrated in FIG. 3. It will be apparent that since the collet finger heads are at locked positions around the locking surface 112 on the rod 92 the collet finger heads cannot enter the restricted upper end of the bore 34 above the locking recess 35 of the stem 23. Thus, when the collet finger heads engage the upper end surface of the stem 23 around the open bore as the module is lowered the collet 100 is forced upwardly on the rod 92 compressing the collet operating spring 110 until the collet finger heads are aligned with the release recess 113 along the rod 92. The edge of the upper end of the valve stem 23 opening into the blind bore 34 of the valve stem coacting with the tapered lower end surfaces of the collet finger heads cams the collet finger heads inwardly so that the heads are nested closely around the rod release surface 113. Further lowering of the module forces the contracted collet finger heads downwardly within the bore 34 as represented in FIG. 4 at which stage in the installation the entire module is being lowered to the seated position on the safety valve with the collet finger heads at the inward release position moving downwardly along the rod 92 as represented in FIG. 4. As soon as the retracted collet finger heads and the rod 92 are inserted to a depth into the bore 34 at which the collet finger heads are aligned with the locking recess 35 the collet finger heads spring back outwardly to normal positions at which the inner surfaces of the collet finger heads are vertically aligned with the locking surface 112 on the operator rod 92. Since the collet finger heads are within the recess 35 and the head 111 of the operator rod is within the recess 35, the collet 100 is free to shift downwardly. The spring 110 expands forcing the collet downwardly with the collet heads moving along the operator rod surface 112 until the lower end edges of the heads engage the upper flange surface on the operator rod foot 111 at the lower end of the locking surface 112. Since the spring 110 is now biasing the collet downwardly on the operator rod and the spring 93 is biasing the operator rod upwardly within the collet, the collet is held at the locking position of FIG. 3. The actuator module cylinder housing is fully seated on the upper end of the safety valve cylinder 25 with the module base member surfaces 60 and 61 seated on the cylinder upper end surfaces as shown in FIG. 3. The module simply rests on the safety valve cylinder housing face 28 coupled with the safety valve only through the collet assembly 44 which releasably engages the safety valve stem 23. The module is thereafter releasable from the safety valve only by means of extension downwardly of the operator rod 92 as described below.

With the actuator module 10 mounted in operating position on the safety valve 11 as shown in FIG. 3 the safety valve may then be reopened by applying hydraulic pressure into the cylinder 25 through the line 32 forcing the piston 31 downwardly along with the lower and upper stems 22 and 23. When the pressure on the piston 31 within the cylinder 25 is raised to a sufficient level to overcome the spring assembly 41 and the line pressure within the passage 13 through the valve body 12 the surface safety valve valve member 20 is shifted downwardly to the open position. With the surface safety valve so equipped wireline operations using the wire 33 may be carried out under conditions of low or no pressure through the flow line in which the safety valve is connected with supplementary energy being stored in the compressed spring assembly 41 to overcome the resistance of the wire 33 and close the safety valve in the event that an emergency develops requiring such closing. With safety valve 11 open and the actuator module 10 energized or "cocked" as shown in FIGS. 1 and 2 the compressed spring assembly 41 confined between the base 55 and the piston 42 of the module applies a constant upward force on the lower face of the piston. The force is transmitted through the retainer ring 65 to the piston rod 43. The upward force on the piston rod applies an upward force to the fitting 85 which applies the upward force to the collet retainer sleeve 101. The upward force on the retainer sleeve is applied to the collet through the sleeve flange 104 which engages the external collet flange 103 applying the upward force to the collet fingers 102. The upward force on the collet fingers which are held against inward movement by the rod locking surface 112 in turn apply the upward force to the upper stem 23 of the safety valve. It is this upward force resulting from the energy stored in the compressed spring assembly 41 which enables the safety valve to close overcoming the additional resistance provided by the wire 33 through the safety valve bore. When the hydraulic pressure is released in the safety valve cylinder 25 the line pressure in the safety valve together with the force of the spring assembly 41 against the piston 42 in combination shift the safety valve back to the close position as represented in FIG. 3.

The actuator module 10 may be removed from the closed safety valve 11 by depressing the collet operator rod 92 downwardly until the release surface 113 on the rod is aligned within the collet finger heads. A hydraulic line 120 is connected into the upper end of the bore 81 of the piston rod 43 as illustrated in FIG. 5. A suitable source of hydraulic pressure such as a hand pump, not shown, is connected with the line 120 applying a hydraulic fluid pressure into the bore 81 which acts over a cross-sectional area of the operator rod 92 defined by the line of contact between the seal 95 and the outer surface of the rod 92 within the fitting 85. The operator rod is forced downwardly compressing the spring 93 and shifting the rod to the position illustrated in FIG. 5 at which the release surface 113 along the rod is moved in alignment with and within the collet finger heads so that the collet fingers may be compressed inwardly around the rod. The module is lifted upwardly so that the upper internal edge surfaces defining the upper end of the valve stem recess 35 cam the collet finger heads inwardly around the rod surface 113 so that the collet assembly may be retracted from the bore of the safety valve stem 23. With the collet assembly 44 thus releasable from the safety valve stem the module is lifted from the safety valve. The hydraulic pressure may then be released in the bore 81 of the piston rod 43 allowing the spring 93 to expand returning the collet assembly to the condition shown in FIG. 3.

As previously discussed when the actuator module 10 is in the "uncocked" or relaxed condition at which the spring assembly 41 is fully extended as shown in FIG. 3, the module can be installed only on a safety valve which has the upper stem extending upwardly above the safety valve cylinder sufficiently for the collet assembly 44 to reach the bore of the stem of the safety valve. The actuator module may, however, be installed upon an open safety valve as shown in FIG. 1 which has the upper end portion of the valve stem 23 retracted downwardly by charging or "cocking" the module fully compressing the spring assembly 41. The module is charged by connecting a suitable needle valve fitting, not shown, into the bore 53 and using a suitable hydraulic pump, not shown, to inject hydraulic fluid into the cylinder chamber 80 above the piston 42. The piston 42 is pumped downwardly compressing the spring assembly 41 until the lower face of the piston engages the top surface of the member 62. The piston rod 43 along with the collet assembly 44 moves downwardly with the piston to the lower end position represented in FIGS. 1, 2 and 4. The needle valve is closed and the pump disconnected from the module cylinder. With the module so fully charged it will be evident from FIG. 2 that the lower end portions of the collet 100 and the collet operator rod 92 project below the lower end of the member 62 so that the collet assembly may be inserted into the upper open end of the blind bore 34 of the safety valve stem 23. The previously described procedure is then followed lowering the module onto the top of the safety valve cylinder 25 until the collet assembly snaps into the locking recess 35 of the safety valve stem and the member 55 of the module is seated on the upper end of the safety valve cylinder. The hydraulic pressure is then relieved in the module cylinder through the needle valve allowing the energy stored in the compressed spring 41 to apply the upward force to the piston 42 thereby adding the supplementary force of the spring assembly to the safety valve stems. If necessary the control pressure in the piston 25 of the safety valve as applied through the line 32 may be increased sufficiently to offset the force from the spring assembly of the actuator module. The module thereafter functions to close the safety valve cutting the wireline in the manner previously described.

In the event that it should be necessary to remove the actuator module 10 from an open safety valve 11 as shown in FIG. 1, the chamber 80 of the module is hydraulically recharged with the hydraulic fluid being sealed in the chamber by closing the needle valve in the port 53. The hydraulic pressure is raised to a sufficient level to overcome the force of the spring assembly 41 to keep the piston 42 at the the lower end position against the upper end of the member 62 while the module is disengaged from the safety valve. After charging the chamber 80 hydraulic pressure is then applied in the bore 81 of the piston rod 43 as previously described to extend the collet operator rod 92 downwardly until the release surface 113 on the rod is aligned within the collet finger heads. The module is then lifted from the safety valve as previously discussed.

When installing the actuator module 10 on an open safety valve or removing the module from an open safety valve, since it is necessary that the collet assembly 44 extended downwardly by charging the module chamber, safety precautions should be taken to ensure that the hydraulic charge within the chamber 80 is not accidentally released prematurely. One technique which will assist in this safety consideration is the use of a single hydraulic pump at an operating site. It will be apparent that in order to remove the module from the open safety valve hydraulic pressure must be applied in the chamber 80 and also in the piston rod bore 81. If the chamber 80 is first charged and sealed and the pump is then shifted to the piston rod, there is less likelihood of an accidental discharge of the pressure in the chamber 80 as might occur if two separate hydraulic pumps were employed.

It will be apparent from the foregoing description and the drawings that a new and improved actuator module for a wireline cutting safety valve has been described and illustrated. The module supplies supplementary force to a safety valve to permit the valve to close under low or no pressure conditions cutting a wireline extending through the safety valve. The module is connected to the safety valve by only the coupling of the module collet assembly with the stem of the safety valve thereby not requiring threaded or other forms of connections between the safety valve and the module bodies. The module is readily installed upon either an open or a closed safety valve.

What is claimed is:

1. An actuator module for use with a wire cutting safety valve to provide supplementary force to said safety valve for cutting a wireline when said wireline is disposed through said safety valve when said safety valve is open, said actuator module comprising: an actuating means for applying a reciprocating force to a valve stem of said safety valve sufficient to cut said wireline when said safety valve is closed, said actuating means including a piston rod having a bore therethrough and means connecting said valve stem of said safety valve with said piston rod, said piston rod and stem connecting means being the sole means for coupling said actuator module with said safety valve stem for holding said module on said safety valve and including a locking collet supported at a first end of said bore in said piston rod for releasably coupling said piston rod with said valve stem, a tubular adaptor secured in said first end of said bore of said piston rod; a collet operator rod slidably disposed through said adaptor in said bore of said piston rod, said operator rod having an operator foot extending from said piston rod at said first end of said housing, said operator foot having a first collet locking surface and second collet release surface spaced from said first collet locking surface; a spring around said operator rod within said bore of said piston rod, a first end of said spring engaging an end of said tubular adaptor; means defining an operating shoulder on said collet operator rod engaging the other end of said spring whereby said spring biases said collet operator rod toward said first end of said piston rod bore in a collet locking direction; seal means between said adaptor and said collet operator rod for forming a fluid tight seal around said operator rod whereby hydraulic pressure introduced into said piston rod bore at a second end of said bore forces said collet operator rod in a direction toward a collet release position; a locking collet having a plurality of circumferentially spaced locking fingers supported on said operator rod for releasably engaging a locking recess in a valve stem of said safety valve, said collet fingers being movable along said rod between locking positions at said first locking surface on said rod and release portions along said release surfaces of said rod; a spring connected around said locking collet having an end engageable with said locking collet for biasing said locking collet away from said adaptor toward a locking position along said collet operator rod; and a retainer sleeve on said adaptor around said locking collet for holding said locking collet with said adaptor.

2. An actuator module in accordance with claim 1 wherein said actuating means for said operator rod comprises means for directing hydraulic fluid pressure from said second end of said piston rod bore to said operator rod to move said operator rod within said collet.

3. An actuator module for use with a wire cutting safety valve to provide supplementary force to said safety valve for cutting a wireline when said wireline is disposed through said safety valve when said safety valve is open, said actuator module comprising: a housing defining a chamber having a first end provided with a seat surface engageable with a seat surface on a hydraulic cylinder of said safety valve by longitudinal motion only of said actuator module toward said safety valve cylinder; a piston in said chamber movable toward and away from said first end; a piston rod connected with said piston and having one end portion extending in slidable sealed relationship through a second end of said housing; a spring assembly disposed within said housing between said piston and said first end of said housing adapted to be compressed by said piston upon movement of said piston toward said first end of said housing for storing energy to apply a force to said piston away from said first end of said housing when said spring assembly is compressed; said housing at said second end of said housing with said piston rod and said piston defining a hydraulic pressure chamber for introducing hydraulic fluid into said housing to move said piston and said rod toward said first end of said housing for compressing said spring assembly; means defining a side port in said second end of said housing for connecting hydraulic pressure means with said chamber in said housing; said piston rod being provided with a bore extending throughout the length of said rod; a tubular adaptor secured in said bore of said piston rod extending toward said first end of said housing; a collet operator rod slidably disposed through said adaptor in said bore of said piston rod, said operator rod having an operator foot extending from said piston rod at said first end of said housing, said operator foot having a first collet locking surface and a second collet release surface spaced from said first collet locking surface; a spring around said operator rod within said bore of said piston rod, a first end of said spring engaging an end of said tubular adaptor; means defining an operating shoulder on said collet operator rod engaging the other end of said spring whereby said spring biases said collet operator rod away from said first end of said housing in a collet locking direction; seal means between said adaptor and said collet operator rod for forming a fluid tight seal around said operator rod whereby hydraulic pressure introduced into said piston rod bore at said second end of said housing forces said collet operator rod in a direction toward said first end of said housing to a collet release position; a locking collet having a plurality of circumferentially spaced locking fingers supported on said operator rod for releasably engaging a locking recess in a valve stem of said safety valve, said collet fingers being movable along said rod between locking positions at said first locking surface on said rod and release positions along said release surface of said rod; a spring connected around said operator rod having an end engageable with said locking collet for biasing said locking collet away from said adaptor toward said first end of said housing to a locking position along said collet operator rod; and a retainer sleeve on said adaptor around said locking collet for holding said locking collet with said adaptor.

* * * * *

UNITED STATES PATENT AND TRADEMARK OFFICE

CERTIFICATE OF CORRECTION

PATENT NO. : 4199131

DATED : April 22, 1980

INVENTOR(S) : Israel Boski, Karl N. Tunstall, M.L. Warren

It is certified that error appears in the above-identified patent and that said Letters Patent are hereby corrected as shown below:

Column 1, line 18 change "1975-75" to --1974-75--;

Column 4, line 24 change "foce" to --force--;

Column 9, line 37 change "the the" to --the--;

Column 10, line 50 change "portions" to --positions--;

Column 10, line 50 change "surfaces" to --surface--;

Column 10, line 51 change "locking collet" to --operator rod--.

Signed and Sealed this

*Twenty-first* Day of *July 1981*

[SEAL]

*Attest:*

GERALD J. MOSSINGHOFF

*Attesting Officer*

*Commissioner of Patents and Trademarks*